United States Patent [19]

Thompson et al.

[11] Patent Number: 4,490,708

[45] Date of Patent: Dec. 25, 1984

[54] CONDITION RESPONSIVE ELECTRIC SWITCH SYSTEM, ELECTRICAL SWITCHING DEVICE AND METHOD OF OPERATION THEREOF

[75] Inventors: Paige W. Thompson; Ronald W. Kelly, both of Morrison, Ill.

[73] Assignee: General Electric Company, Fort Wayne, Ind.

[21] Appl. No.: 391,607

[22] Filed: Jun. 24, 1982

[51] Int. Cl.[3] ..... H01H 37/12; H01H 37/38; H01H 37/60

[52] U.S. Cl. ..... 337/320; 337/117; 337/317; 337/319

[58] Field of Search ..... 337/117, 114, 115, 116, 337/119, 306, 307, 309, 310, 311, 312, 313, 314, 315, 316, 317, 318, 319, 320, 321, 323

[56] References Cited

U.S. PATENT DOCUMENTS

| | | | |
|---|---|---|---|
| 2,866,025 | 12/1958 | Moran | 335/193 |
| 2,882,369 | 4/1959 | Bauer | 335/132 |
| 3,065,320 | 11/1962 | Cobean | 337/319 |
| 3,065,323 | 11/1962 | Grimshaw | 337/318 |
| 3,096,419 | 7/1963 | Howell | 337/320 |
| 3,225,160 | 12/1965 | Barkan | 335/195 |
| 3,344,246 | 9/1967 | Mamiya | 200/67 D |
| 3,354,280 | 11/1967 | Slonneger | 337/320 |
| 3,457,533 | 7/1969 | Whitaker | 335/192 |
| 3,648,214 | 3/1972 | Slonneger | 317/319 |
| 3,735,080 | 5/1973 | Andresen | 200/67 D |
| 3,800,250 | 3/1974 | Mori et al. | 335/128 |
| 4,284,864 | 8/1981 | Crow et al. | 200/153 V |

OTHER PUBLICATIONS

"General Electric Cold Controls" GEA-9954 (5M) 10/73 (12 Pages).

"Appliance Control Department Cold Controls" GEA 10879 (5M) 10/80, 16 pages.

*Primary Examiner*—Harold Broome

*Attorney, Agent, or Firm*—Joseph E. Papin

[57] ABSTRACT

A condition responsive electric switch system comprises switch means which includes at least one set of contact elements defining a preselected open position, a preselected closed position, and a preselected initial contact make-break position, disposed between the open and closed positions. Switch actuating means is movable in actuating relation with the switch means for operating the contact elements selectively into and out of the three preselected positions. Spring means and temperature responsive means are connected to and impart motion to switch actuating means, with the spring means and temperature responsive means creating opposing forces on the switch actuating means. The condition responsive electric switch system has both positive and negative spring gradients including a force producing means having maximum absolute positive gradient forces $F_1$ and $F_2$ in which $F_1$ = maximum absolute positive gradient pre-load force on the contact elements at the preselected initial contact make-break position; $F_2$ = maximum absolute positive gradient force on the contact elements at the preselected closed position wherein the value of the expression $(F_2-F_1)/F_2$ should not be substantially less than unity. A net contact element force is also produced generally in the vicinity of zero as the contact elements pass at least through the preselected initial contact make-break position. The system further includes means for adjusting the larger negative spring gradients in the system.

An electrical switch device and a method of operating the switching device are also disclosed.

24 Claims, 30 Drawing Figures

20
21
22
23
24
26
27
28
29
31
32
33
34
35
36
37
38
41
42
44
47
48
51
52
53
54
56
57
58
61
62
63
64
66
67
68
71
72
73
76
77
78
81
82
83

FIG. 4
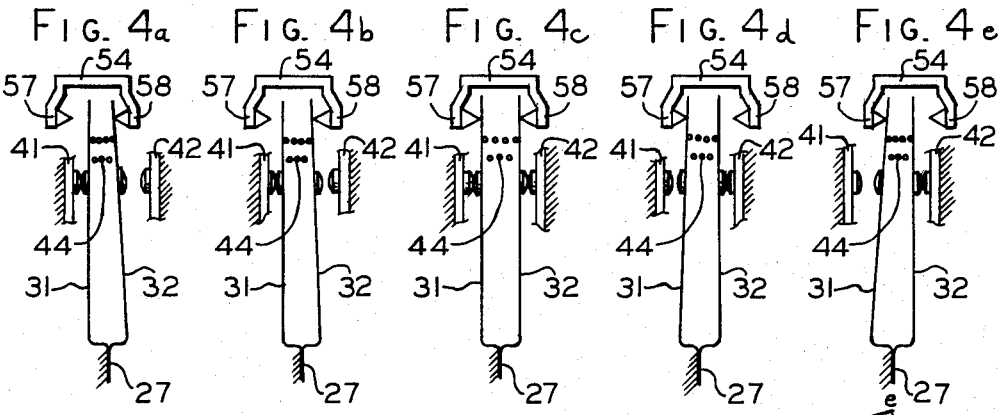
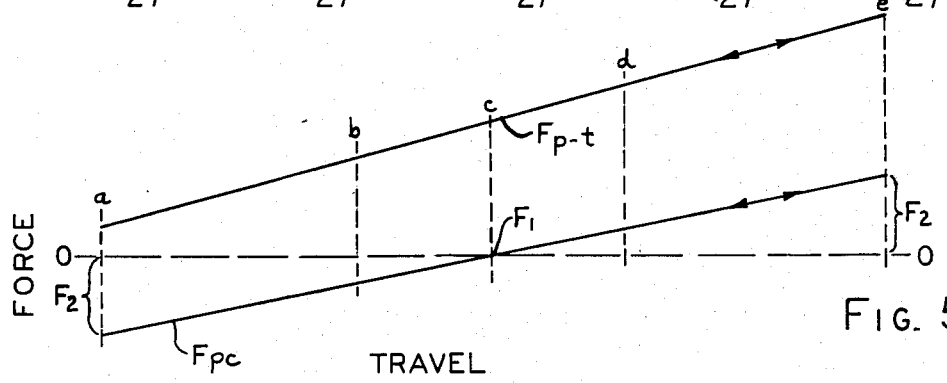
FIG. 5
FIG. 6
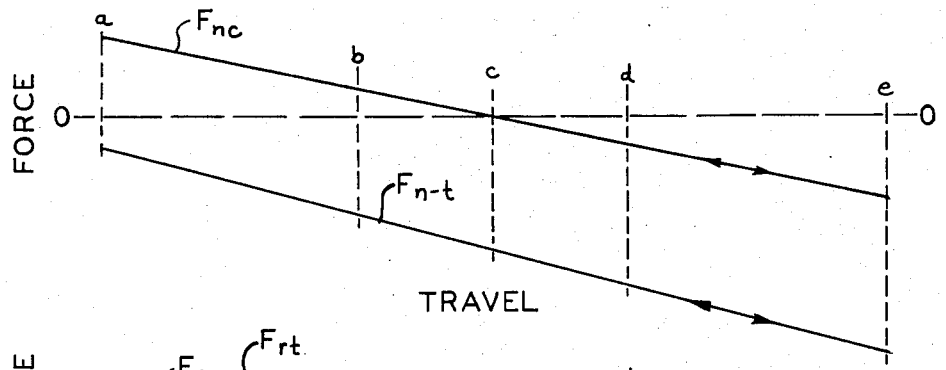
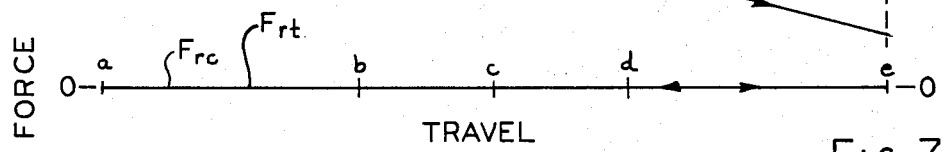
FIG. 7

FIG. 17
FIG. 17a
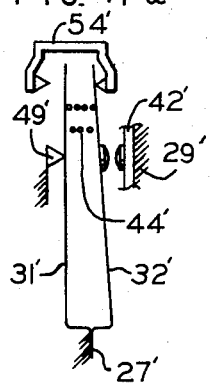
FIG. 17c
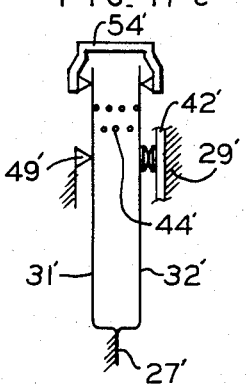
FIG. 17e
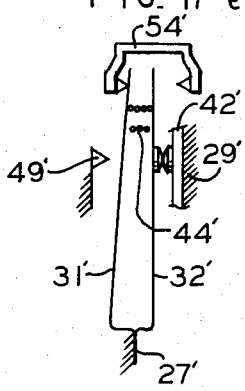
FIG. 18
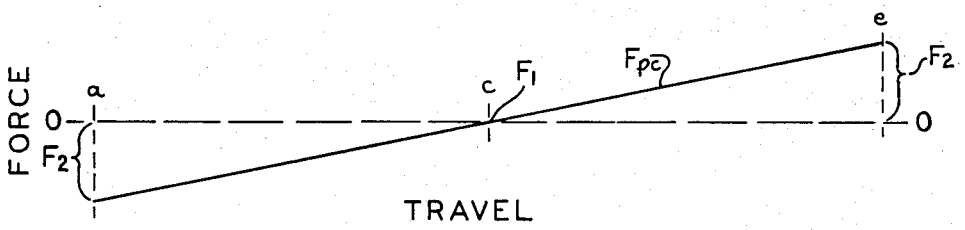
FIG. 19
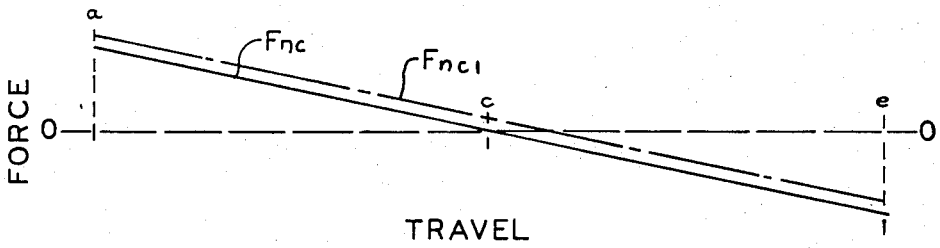
FIG. 20
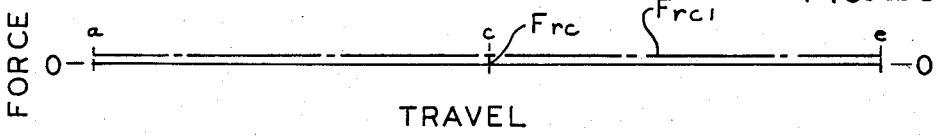

CONDITION RESPONSIVE ELECTRIC SWITCH SYSTEM, ELECTRICAL SWITCHING DEVICE AND METHOD OF OPERATION THEREOF

FIELD OF THE INVENTION

The present invention relates generally to circuit controls in particular to an improved condition responsive electric switch system, an improved electrical switching device, and an improved method of operating such device.

BACKGROUND OF THE INVENTION

Electrical switching devices, especially those employed in the control of electrical circuits in domestic appliances, are often operated by changes in temperature, pressure, liquid levels, electric power, or the like and utilize various different power elements, such as bi-metals, bellows, floats, and magnetic armatures or the like for instance. Such power elements must be of sufficient size to properly operate the contacts for switching the electrical load of relatively high currents for a large number of trouble free cycles of operation, for instance for more than 100,000 cycles of load life in one particular application. It is highly desirable to keep the size of the unit small and compact, low in cost, yet the components of the unit must be sufficiently rugged to operate properly over long periods of time without failure. Additionally, it is desirable to maintain the differential in the working substance, such as temperature and pressure changes or the like for instance, within small limits for best control. It is also desirable that the switching devices be versatile in nature, essentially no contact bounce which could otherwise produce arcing and potential contact welding, and enough contact wipe, for instance 0.010 inch, so that wear will not be detrimental to the operating characteristics of the device. It is additionally desirable to be able to accomplish the foregoing without the need to totally redesign existing devices. These advantageous features and desirable attributes should be obtained in an economical yet highly effective manner.

Accordingly, it is an object of the present invention to provide an improved electrical switching device and a method of operating which provide the more important desirable features identified above.

It is another object of the present invention to provide an improved electrical switching system which is sturdily and economically built, relatively compact, and capable of trouble-free operation over a long period of time, yet which has components adapted to furnish amplified contact forces.

SUMMARY OF THE INVENTION

In carrying out the objects of the invention in one form we provide an improved electrical switching system having both positive and negative gradients with switching means selectively operable generally between a pair of switching modes through an initial contact make-break position. Resilient means, having a positive spring gradient of predetermined value is associated with the switching means for exerting a force on the switch means at a first predetermined force level $F_1$ as the switching means travels through the initial contact make-break position and a substantially higher force level $F_2$ when the switching means is in one of the switching modes. The value of the expression $(F_2-F_1)/F_2$ should not be substantially less than unity and preferably should approach unity. Actuator means is associated with the resilient means and the switching means for effecting operation of the switching means between its switching modes and for introducing at least a negative spring gradient of predetermined value on the switching means as that means enters and leaves the switching modes of sufficient magnitude to substantially off-set the force resulting from the resilient means during that part of the switching operation. The system also includes means for adjusting at least one of the spring gradients, with the net force acting on the switching means essentially approaching zero in at least one of the switching modes. With this arrangement a force amplification is readily furnished without the need for a corresponding increase in net work in the system to achieve the force gains, among other advantageous features to be explained more fully hereinafter.

We also provide an improved method of operating an electrical switch having at least one set of contact elements which include open and closed, position with initial contact make-break positions being disposed between the other two. In one form of the method, the steps comprise transferring the contact elements into and out of the open and closed positions by means having predetermined positive and negative spring gradients. As the contact elements are passing through the initial contact make-break position a force is exerted on the elements resulting from a positive spring gradient substantially less in magnitude than the force acting on the elements from the same spring gradient when the contact elements are in the closed position. During this step, a net force is concurrently exerted on the contact elements which essentially is in the vicinity of zero so that very little net work is involved in spite of the relatively high levels of force produced in the operating switch modes.

The above-mentioned and other desirable and advantageous features and objects of this invention and the manner of attaining them will become more apparent and the invention itself better understood by reference to the following description of the preferred embodiments of the invention taken in conjunction with the accompanying drawings.

BRIEF DESCRIPTION OF THE DRAWINGS

FIG. 4*a* is a schematic presentation of a part of the switch actuator and of the two sets of contact elements of the switch mechanism illustrated in FIGS. 1, 2, and 3 showing one set of contact elements in a fully closed position while the other set of contact elements is in the fully open position, different switching modes respectively for the two sets of contacts;

FIG. 4*b* is a schematic presentation similar to that of FIG. 4*a* revealing the switching components in intermediate closed and open positions respectively, approximately $\frac{1}{3}$ of the total distance of travel for the components, the switching modes being the same as those seen in FIG. 4*a;*

FIG. 4*c* is a schematic presentation similar to FIGS. 4*a* and 4*b* illustrating the initial contact make-break position for each of the two sets of contact elements, approximately central position for the switch actuator, where the elements enter and leave the switching modes;

FIG. 4*d* is a schematic presentation similar to FIGS. 4*a–c* wherein the switching components are in intermediate open and closed positions respectively, the positions being about ⅓ of the total distance of travel and the reverse positions for the components of those seen in FIG. 4*b;*

FIG. 4*e* is a schematic presentation similar to FIGS. 4*a–d* in which the two sets of contact elements are in the fully open and closed positions respectively, the reverse switching modes of those shown by FIG. 4*a;*

FIG. 5 are typical force vs. contact element travel diagrams for the embodiment of FIG. 1 showing the absolute positive gradient force produced on the contact elements as well as the major positive gradient force of the system with such minor superimposed forces resulting from friction, contact blades, and lost motion being omitted for purposes of clarity;

FIG. 6 are typical force vs. contact element travel diagram for the embodiment of FIG. 1 showing the absolute negative gradient force produced on the contact elements as well as the major negative gradient force of the system, again with minor superimposed forces being omitted;

FIG. 7 is the resultant net force vs. deflection curves for the combined diagrams of FIGS. 5 and 6;

FIG. 17*a* is a schematic presentation of a modified form of the embodiment of FIG. 1 incorporating another form of the present invention in which the switching mechanism has one rather than two sets of contact elements, the FIG. revealing the components in the fully open position, one switching mode;

FIG. 17*c* is a presentation similar to FIG. 17*a* but the components are in the initial contact make-break position;

FIG. 17*e* is a presentation similar to FIGS. 17*a* and *c* but the components are in another switching mode, the fully closed position;

FIG. 18 is a typical positive gradient force vs. travel diagram for the single set of contact element embodiment, a presentation corresponding to the kind set out in FIG. 5 for the first embodiment;

FIG. 19 are typical negative gradient force vs. travel diagrams for the single set of contact element embodiment of FIGS. 17*a, c, e* and 18; and FIG. 20 are resultant net force vs. deflection curves of the combined diagrams of FIGS. 18 and 19.

DESCRIPTION OF THE PREFERRED EMBODIMENTS

Figure 1:
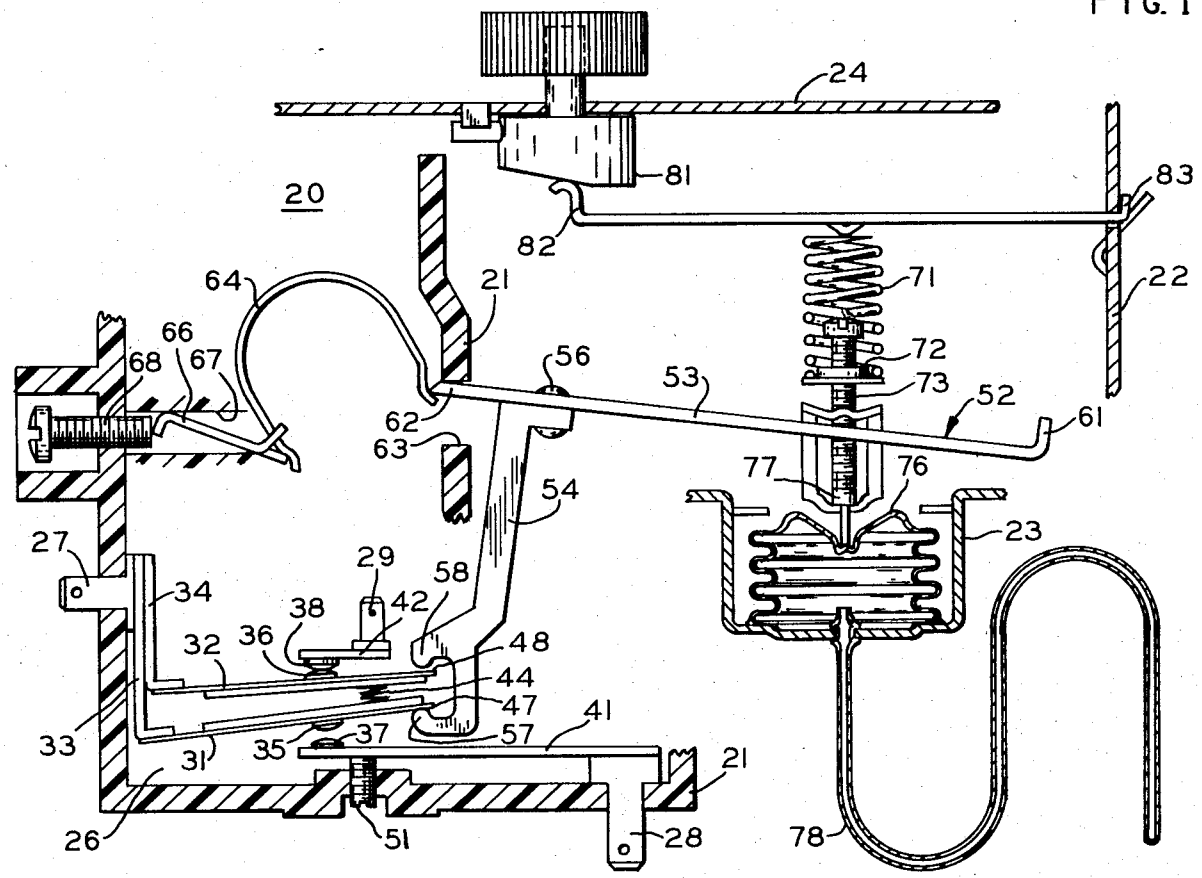
FIG. 1 is a side view, partially in cross section, schematically illustrating one form of the present invention incorporated in a condition responsive electric switch system.

Referring now to FIGS. 1–7 inclusive, one form of the present invention is shown incorporated in a condition, such as temperature, responsive electric switch device 20, which is commonly referred to as a cold control. The exemplification device is an improvement of the general type more fully disclosed in U.S. Pat. No. 3,065,323—C. Grimshaw and U.S. Pat. No. 3,065,320—R. W. Cobean both issued on Nov. 20, 1962; U.S. Pat. No. 3,096,419—L. J. Howell granted July 2, 1963; U.S. Pat. No. 3,354,280 issued Nov. 21, 1967 and U.S. Pat. No. 3,648,214 granted Mar. 7, 1972 both of J. L. Slonneger, the disclosures of these U.S. patents are incorporated herein by reference.

In the exemplification device 20 has a housing generally similar to that disclosed in more detail in U.S. Pat. No. 3,648,214 which by way of illustration may include a housing 21 suitably formed of molded phenolic thermosetting plastic, and a somewhat U-shaped frame 22 constructed of any suitable material such as stainless steel, the housing and frame being securely mounted together in an assembled relation by any means, such as posts (not illustrated). In the conventional way frame 22 supports a bellows assembly 23 and cover assembly 24 which includes the means (not shown) for mounting device 20 onto a suitable supporting panel.

Figure 2:
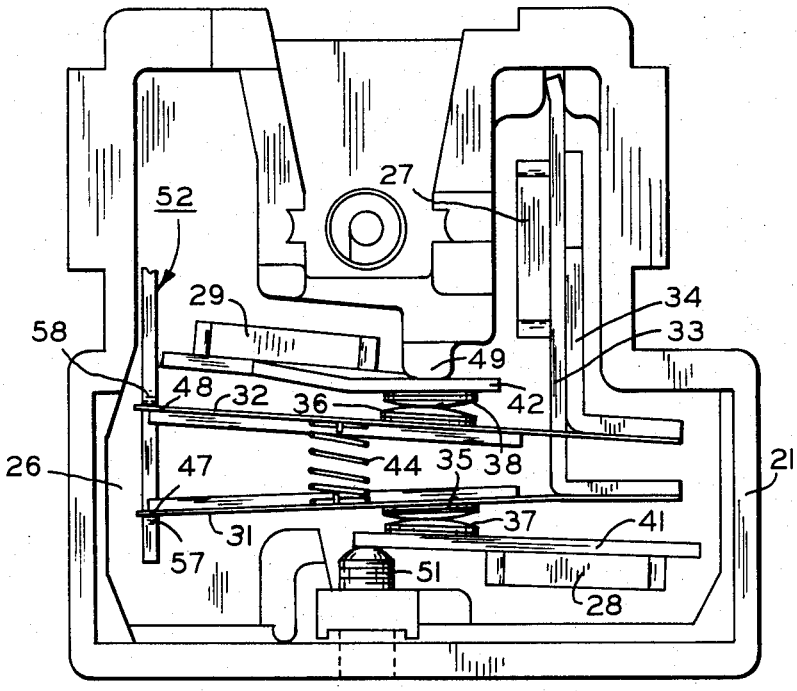
FIG. 2 is an end view of the switch device part of the system having the switching mechanism, with some parts broken away for purposes of clarity.

As best revealed by FIGS. 1 and 2, housing 21 accommodates the two sets of contact elements of the switch mechanism and their associated terminals in chamber 26 of the illustrated embodiment. Terminals 27, 28, and 29 are each securely attached to the housing so as to furnish stable external connections for associated wiring and a stable support respectively for the various contact elements of the switch mechanism. Resiliently biased and movable contact elements 31, 32 are electrically and mechanically connected at one of their ends through L-shape members 33, 34 to common terminal 27 such that elements are in spaced and somewhat parallel relation. Laminated contacts 35, 36, each having a convexly curved face preferably formed of silver, are secured as by conventionally welding, respectively facing toward similar contacts 37, 38 carried by fixed contact elements 41, 42 attached at one end respectively to terminals 28, 29. A coil spring 44 having a predetermined positive spring gradient, to be discussed more fully hereinafter, is attached between contact elements 31, 32 at a location between the contacts 35, 36 and free ends 47, 48 and provides, among other things, a wiping action of the sets of contacts as the pairs of elements pass into and out of their respective modes during operation. In regard to the pairs of elements, contact elements 31, 41 cooperate as a set to define one switch of the mechanism while the second switch is furnished by contact element set 32, 42. Shoulder 49 (FIG. 2) of housing 21 bears against element 42 to form a fixed position for that element. On the other hand, screw 51 adapted to bear against element 31 near its free end and threadily received through housing 21 so that it is accessible from outside the housing, provides the desired adjustable means to define the fixed position of contact element 41 with respect to the other switch components for preselected spacing purposes.

Still referring to FIGS. 1 and 2, in order to actuate selectively the two sets of contact elements 31, 41 and 32, 42 through switching modes, there is provided a switch actuator 52 having a motion transmitting arm member 53 and a depending switch operating arm member 54 securely riveted at 56 near one end of member 53 so that the two members move as a single unit. The lower end (as viewed in FIG. 1) has a bifurcated section with projection 57 overlying the free end 47 of element 31 and a second projection 58 overlying end 48 of element 32 to selectively operate these elements in response to rotational movement of member 53. The right end 61 of member 53 is a base portion to provide securement and a pivot for the actuator. The left end 62 projects through opening 63 in the housing wall and is engaged by one end of a differential snap action toggle spring system with spring 64 producing a predetermined negative spring gradient in the system. The other end of spring 64 is in turn supported by an adjustable pivot member 66 positioned in channel 67 for longitudinally sliding movement within housing 21. A differential-adjusting screw 68 threadily received in another part of housing 21 to be accessible from outside the housing, furnishes a linearly movable, adjustable support for the left side of spring 64. The screw thus bears against the side of member 66 remote from spring 64 so that by adjusting the position of the screw, the tension of the spring 64 and its force with respect to actuator 52 may be readily adjusted a predetermined amount. Member 53 may be additionally supported for pivotal movement about engagement with shoulders and slots (not shown) in the manner disclosed in U.S. Pat. No. 3,648,214 and will not be further discussed.

It should be noted at this time that device 20, like the one in U.S. Pat. No. 3,648,214, is conventionally provided with a helical range spring 71 having a positive spring gradient which acts through a nut 72 and screw 73 to exert a continuing force onto the member 53, thereby tending to rotate it in a counterclockwise direction. This force may be overcome by increasing the force which bellows 76 of assembly 23 exerts on lower section 77 of the screw, which tends to lift the screw against the force of range spring 71. The interaction of bellows 76 and spring 71 on member 53 is well-known and will not be further reviewed other than to note that by varying the compression of range spring 71, the sensed temperature level at which the cold control operates may be adjusted. This function is supplied by a manual adjustable cam 81 rotatably supported on cover 24 by any suitable way. The cam 81 engages cam follower portion 82 which is pivotally mounted as at 83 to frame 22. The upper end of range spring 71 engages the underside of the follower 82 so that the cam follower responds to the rotary positioning of the cam, the amount of the compression of spring 71 between follower 82 and nut 72 being changed.

Generally speaking, in the system spring 64 generates a negative spring gradient bias force through the toggle linkage on actuator 52 which may be overcome by the range spring 71 to move the actuator in a counterclockwise direction. The force of the range spring is opposed by bellows 76 and is effectively exerted on member 53 only when the temperature sensed by the bulb 78 is below a predetermined level so that the force bellows 76 is reduced below a predetermined level.

By one aspect of the present invention as incorporated in the embodiment illustrated in FIGS. 1 and 2, a force amplification is readily furnished without requiring a corresponding increase in net work to attain the gains in force. More particularly, FIGS. 1–7 inclusive illustrate the ideal situation where maximum benefit may be derived when the present invention is incorporated in the condition responsive electric switch device 20 of the illustrated exemplification. FIG. **4*a* schematically shows contact elements 31, 41 in the fully closed position while contact elements 32, 42 are fully open. In this position, denoted at "a" in FIGS. 5, 6, and 7, the positive spring gradient resulting from spring 44 is a force $F_{pc}$ having stored a substantial force $F_2$, by way of example only, about 50 grams or more operating on the engaging faces of closed contact elements 31, 41. This force may be preselected by determining the precise location of spring 44 relative to the contacts and pivot 27 as well as its positive spring gradient value prior to mounting it at the desired location. The major positive spring gradients of the system resulting from spring 44, range spring 71 and bellows 76 are shown in FIG. 5 by force $F_{p\text{-}t}$. In FIG. 6 the negative spring gradient force $F_{n\text{-}t}$ represents the total force in the system attributable to adjustable U-shaped spring 64** with $F_{nc}$ being the force resulting from that spring acting on the closed contact elements which substantially offsets force $F_{pc}$.

The reverse switch mode for the switch mechanism is schematically shown in FIG. **4*e* where contact elements 31, 41 are in the fully open position and contact elements 32, 42 are fully closed. At this location the force $F_2$ approximates that for position "a". In this exemplification the entering and leaving pair of switching modes occurs at a central location "c" located about half-way between "a" and "e" where the initial make-break and break-make positions (contact faces first become engaged or disengaged) occur simultaneously. This position is revealed schematically in FIG. 4*c***. At that instant both forces $F_{pc}$ and $F_{nc}$ cross the 0—0 force line and force $F_1$ is approximately zero even though there is no contact gap between cooperating contact elements at central position "c".

It should be noted at this time that the maximum absolute positive gradient force $F_2$ on the appropriate contact elements at each of the positions "a" and "e" is at a level substantially greater or higher than the level of the maximum absolute positive gradient force $F_1$ at the initial make-break position "c" which is zero and therefore negligible in the exemplification. Stated another way, the value of the expression $(F_2-F_1)/F_2$ in this embodiment is unity since $F_1$ is zero in value. In addition, force-travel curves $F_{pt}$, $F_{pc}$, $F_{n\text{-}t}$, and $F_{nc}$ (FIGS. 5 and 6) are each generally linear throughout the entire operating range (e.g., between positions "a" and "e") for the illustrated embodiment and have force values as predetermined by the relevant springs identified above which produce these forces such that the net force $F_{rc}$ acting on the engaging contact elements as well as the net force $F_{rt}$ of the system each are in the vicinity of zero in a linear manner for the entire operating range between positions "a" and "e" as clearly revealed in FIG. 7. Thus, the net work, that is that area respectively between force curves $F_{rc}$ and $F_{rt}$ on the one hand and the 0—0 line on the other is negligible. Consequently, there is provided the ideal situation where the maximum benefit is derived for the illustrated embodiment of FIGS. 1-7 inclusive of force amplification achieved with negligible net work. We believe that the closer the value of the expression $(F_2-F_1)/F_2$ is to unity and the net force $F_{rc}$ acting on the contact elements approaches zero force (force line 0—0) in a linear manner for the greater part of the switching operation, the more significant will be the benefits derived from the present invention.

For the purpose of describing the manner in which device 20 of the exemplification operates, it will be assumed that the two sets of contact elements of the switch mechanism are in the positions shown in FIGS. 1 and 4*e* where elements 32, 42 are in the fully closed position and elements 31, 41 are fully open. It will be recalled that the positive and negative forces acting on the movable switch element 32 is indicated at "e" respectively in FIGS. 5 and 6. The vertical distance $F_2$ from force line 0—0 is a measurement of these forces. Assume further that bulb 78 senses a decrease in temperature which decreases the vapor charge to effect a desired contraction in bellows 76. This in turn causes a decrease in the force exerted on screw bottom 77. The helical range spring 71 therefore overpowers the bellows to the point where at a predetermined sensed temperature the counterclockwise force on end 62 of member 53 is overcome and end 62 of member is snapped downwardly from engagement with the upper wall of opening 63 and into engagement with the bottom wall of the opening. During this operation member 54 of actuator 52 and elements 32, 42 are caused to move from the position or switching mode shown in FIG. 4*e* to the fully open position for elements 31, 32 and fully closed of elements 31, 41 or switching mode shown in FIG. 4*a*.

It should be observed at this time that the spacing for the switch elements and the force curves are such that at the initial make-break position for both sets of elements 31, 32 and 41, 42 are shown in FIG. 4*c*, spring 44 is at free length and therefore does not exert any force on either contact element 31 or 32. In other words, as will be seen more clearly from a comparison hereinafter of FIGS. 12*b* and 12*d* of a PRIOR ART device, in the illustrated embodiment there is no spring arrangement providing a pre-load of large magnitude at the initial make-break position to cause a dramatic jump or rapidly changing discontinuity in forces. As the elements travel away from position "c" in either direction the gradient of spring 44 gradually increases, (FIG. 7) thereby building up the force in a linear manner until it is a maximum $F_2$ at positions "a" and "e". In addition, the positive (FIG. 5) and negative (FIG. 6) forces approach zero as the sets of elements travel entirely through the initial make-break position of FIG. 4*c* (e.g., at least between locations "b" and "d") where the net resultant force $F_{rc}$ is also maintained at approximately zero. While these forces show no discontinuity in the curves at that position since both sets of contact elements enter and leave the initial make-break position at about the same time, it will be understood that the elements need not pass through this position exactly at the same time, thus producing a slight discontinuity which will not greatly diminish the benefits attributable to the present invention. This will be discussed more fully below in connection with FIGS. 8, 9, and 10. It should also be noted that in the illustrated embodiment it is easier to adjust the magnitude of the negative spring forces produced by spring 64 in the system to approximate that of the positive spring gradient (e.g., spring 44) than to do the converse (adjust spring 44) so that both forces $F_{pc}$ and $F_{nc}$ are approximately equal in absolute values and preferably cross the zero force line 0—0 in the vicinity of position "c" by proper adjustment of the contact spacing and location. It will be recalled that screw 68 may be employed to attain the negative gradient adjustment where for example an increase in force $F_{nc}$ may be obtained by a decrease in spacing of the bight of U-spring 64. The net resultant force $F_{nc}$ may thus be provided near or in the vicinity of the zero force line 0—0 for the entire operation as shown in FIG. 7.

When conditions are such that the forces on the actuator cause it and the elements 31, 32 to be moved once again to the switching modes illustrated in FIGS. 1 and 4*a* from that of FIG. 4*e*, the elements will pass through the positions illustrated in FIGS. 4*d*, *c*, and *b* with the generally linear positive and negative force pattern shown by FIGS. 5 and 6. During operation of the contact elements between the initial make-break position at "c" to either of the full force contact positions denoted by letters "a" and "e", there is little if any rolling or skidding of the engaging contact faces relative to each other. In addition, should contact face wear occur during operation to produce a space greater than that desired between the cooperating contact elements at position "c", it is relatively simple to make the proper adjustments in the system to provide the desired force characteristics for the switch mechanism.

Figure 8:
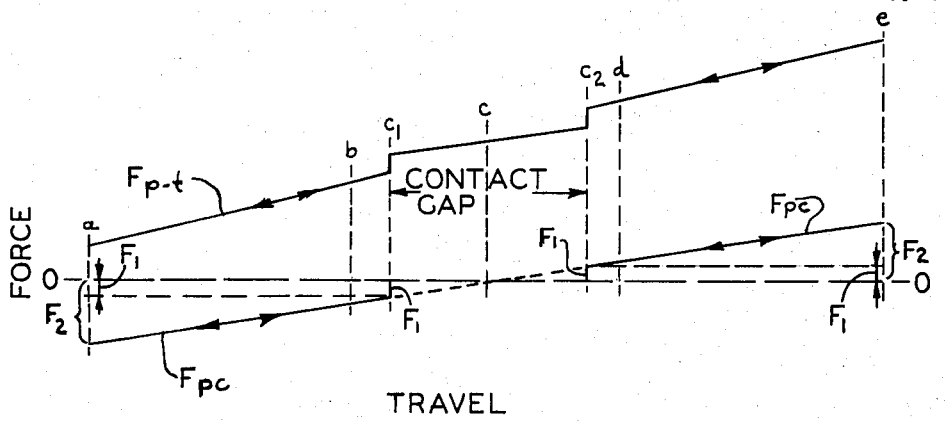
FIG. 8 are similar positive gradient force-travel diagrams to those in FIG. 5 except that these diagrams are typical for an embodiment where the absolute positive gradient contact element force includes a slight but not substantially detrimental discontinuity at the initial contact make-break positions and a small contact gap between those positions.
Figure 9:
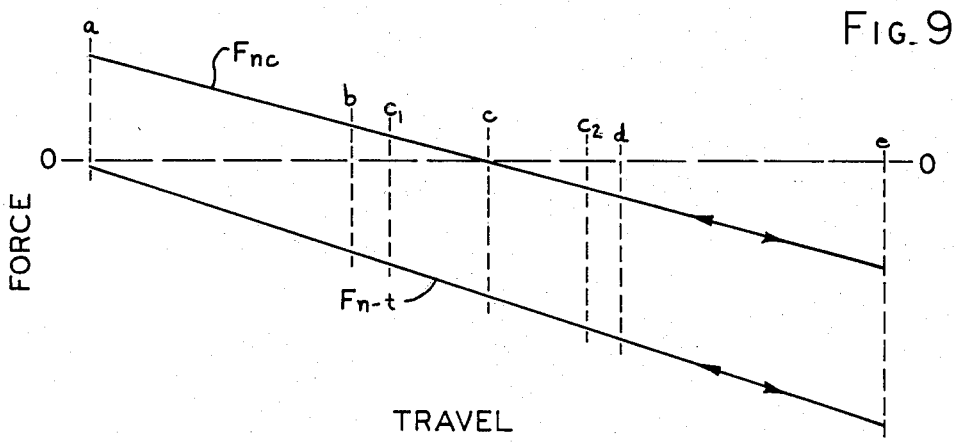
FIG. 9 are similar negative gradient force-travel diagrams to those in FIG. 6 but are representative of the embodiment having the positive gradient characteristics revealed in FIG. 8 where the negative gradient forces have been adjusted to compensate for the slight discontinuities.
Figure 10:
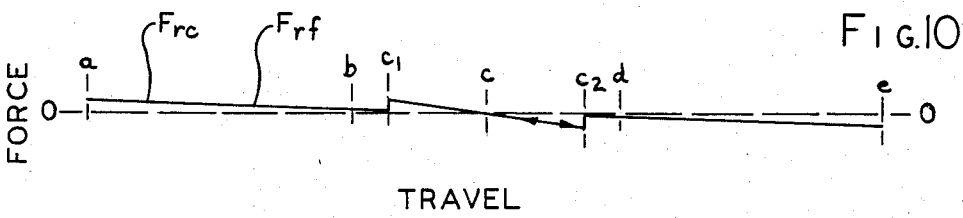
FIG. 10 are the resultant net force vs. deflection curves for the combined diagrams of FIGS. 8 and 9.

Considering now FIGS. 8, 9, and 10 in connection with device 20, a contact gap occurs between $C_1$-$C_2$, preferably not substantially greater in travel than $\frac{1}{4}$ the total travel distance for the contact elements between "a" and "e", where both sets of contact elements are out of engagement. A slight discontinuity for the positive spring gradient produced in curves $F_{pt}$ and $F_{pc}$ by a preload of spring 44 on the contact elements also occurs at $C_1$ and $C_2$, the initial contact making and breaking positions for this situation. This situation may be caused by application requirements for device 20 and by manufacturing tolerances, among other possible reasons. It will be appreciated from curve $F_{pc}$, however, that even with the small discontinuity force $F_1$ is substantially less than $F_2$ and the value of the expression $(F_2-F_1)/F_2$ still in effect approaches unity. For example in actual practice a number of devices 20 were constructed in which $F_1$ was 6 grams and $F_2$ was 51 grams. Therefore the value of the expression was 0.88. As will be seen from an examination of linear curve $F_{pc}$ in FIG. 8 the closer the curve extends toward midpoint "c" the smaller will become the discontinuity (see broken line curve between $C_1$, $C_2$), the two components of curve $F_{pc}$ in effect being linear as a single straight line. The negative spring gradient and forces $F_{nt}$ and $F_{rc}$ (FIG. 9) introduced by adjustable spring 64 are preselected to compensate for the forces shown in FIG. 8. It will be understood from FIG. 10 that for both resultant curves $F_{rc}$ and $F_{rt}$ and their respective relationship to line 0—0 the net work over the operating range between "a" and "e" is still very small in spite of the amplification of force benefits noted above.

Figure 3:
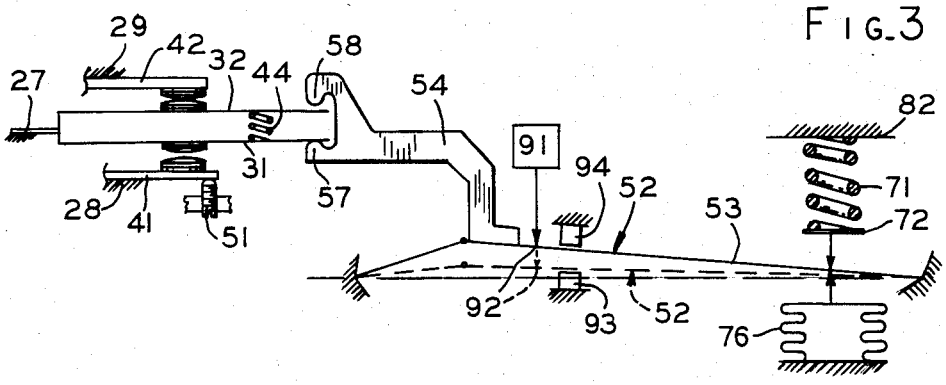
FIG. 3 is a simplified schematic representation of the switch system shown in FIG. 1 showing a standard way to obtain a force-deflection diagram for the switching mechanism in the illustrated embodiment.
Figure 11:
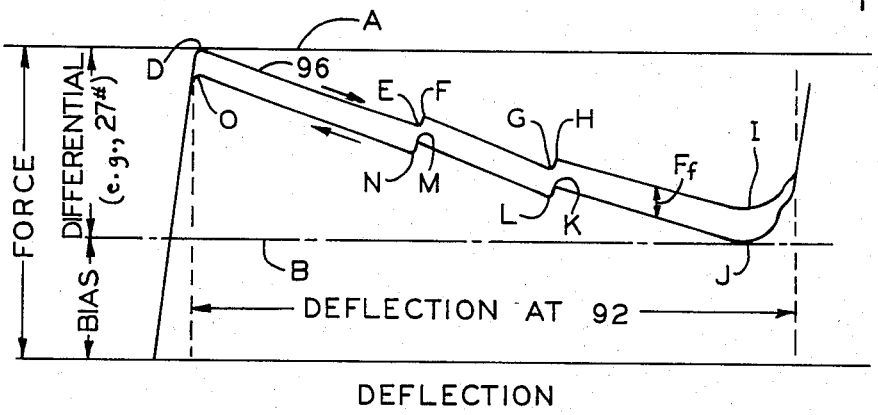
FIG. 11 is an X-Y diagram obtained by a standard scope employed in the conventional way illustrated in FIG. 3 showing typical forces and movement of the switch acutating arm for the system of FIG. 1 which incorporates one form of the present invention.

To fully appreciate the significance of the embodiment exemplified by FIGS. 8–10, a simplified schematic representation of device 20 has been illustrated in FIG. 3 and the manner of attaining the X-Y scope diagram of FIG. 11 will now be considered. In the adjustment of device 20, the temperature of bellows 76 is maintained at a constant bias temperature above the operating temperature to cause the elements to operate toward the closed position as a standard plotter probe 91 operates to the broken line position in FIG. 3 operating the mechanism to point 92 to open contacts 32, 42. By stroking member 53 between a pair of stops 93, 94 employing probe 91, X-Y force-deflection diagram such as that shown in FIG. 11 is constantly on the scope screen to permit proper adjustments to be made to device 20. Line 96 illustrates a typical force-movement characteristic corresponding to the bulb sensing a difference in temperature as the arm 53 snaps to 92. The vertical difference F between curves D-I and J-O is caused by such forces as two times those generated by friction, lost motion, and the like. Point D illustrates the condition at which the forces on member 53 become balanced by probe 91 near upper force level A and will produce the same line 96 as the member is forced through its deflection by probe 91 in increment E, F, G, H, I with portions E, F, and G, H indicating respectively initial break and make of the contact elements. Assuming increasing temperatures, J is another condition where the forces become balanced and the device would snap from 92 to the shown condition. Member 53 will trace the curve K, L, M, N, O with K, L and M, N indicating the initial breaking and making of the contact elements with slight discontinuities built in the mechanism so that these points are observable in the scope. It will be observed from FIG. 11 that for a given differential, such as a force of 0.27 pounds, the forces at E, F and L, K are sufficiently away from level lines A and B so as not to be critical in adjustments and there is no possibility of any stalling of the contact elements when passing through the initial make-break positions. If stalling occurs, the contact elements might be maintained in the make-break position where the contacts could repeatedly touch and break or bounce thereby ultimately causing a welded condition.

Figure 12:
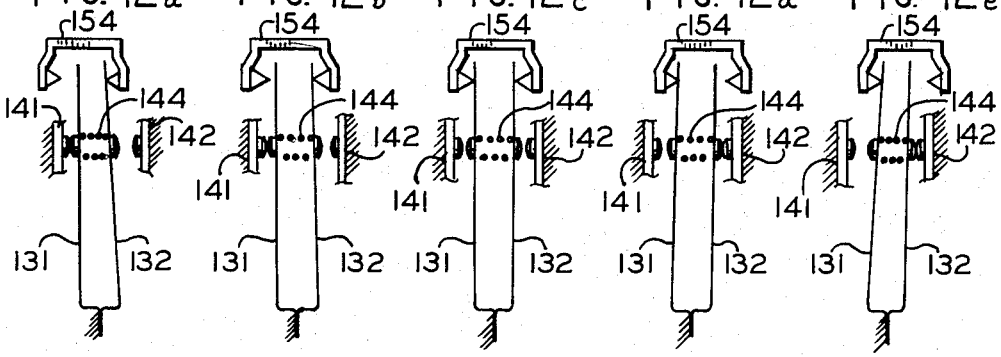
FIG. 12 PRIOR ART
FIGS. 12*a–e* inclusive are schematic presentations of two sets of contact elements in PRIOR ART devices which do not incorporate the present invention, operating through different switching modes and are included for comparison purposes with the presentations of FIGS. 4*a–e* inclusive.
Figure 13:
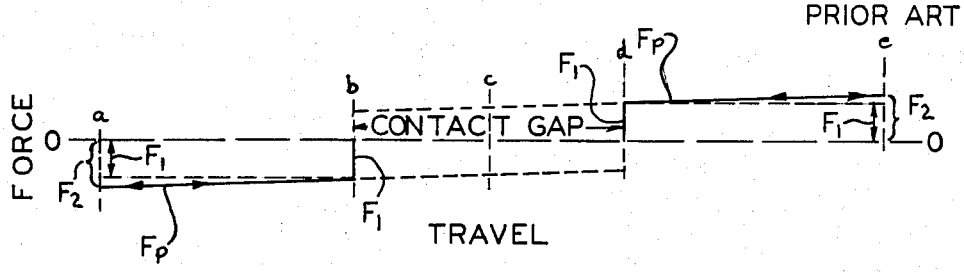
FIG. 13 PRIOR ART
FIG. 13 is a typical major positive gradient contact element force vs. contact element travel diagram of the PRIOR ART device referred to above in FIGS. 12*a–e* inclusive above.
Figure 14:
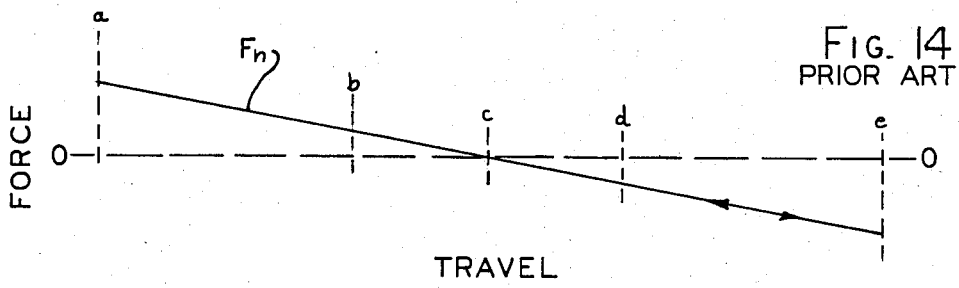
FIG. 14 PRIOR ART
FIG. 14 is a major negative gradient contact element force vs. contact element travel diagram of the PRIOR ART device referred to above in FIGS. 12*a–e* inclusive and 13.
Figure 15:
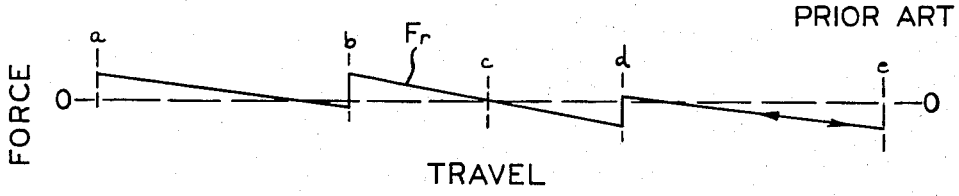
FIG. 15 PRIOR ART
FIG. 15 is the resultant net force vs. deflection curve of the combined diagrams of FIGS. 13 and 14.

Further attributes of the present invention may become even better understood from a consideration of FIGS. 12*a* through *e* and FIGS. 13, 14, and 15 which pertain to the same PRIOR ART cold control device Model 3 ART 24 where similar items are similarly identified with those already discussed. This PRIOR ART cold control is schematically illustrated on page 6 of General Electric brochure GEA-9954 (5M) 10/73, the brochure being incorporated herein by reference. For ease of comparison movable contact elements are denoted by numerals 131, 132 respectively cooperating with fixed contact elements 141, 142. The switch actuator member is 154 and its positive gradient spring is denoted at 144 which in one version was attached to the two movable contact elements directly between the respective contacts. FIG. 12*a* shows elements 131, 141 in the fully closed position with elements 132, 142 being open. FIG. 12*e* has the reverse positions, elements 131, 141 being closed and elements 132, 142 being open. Forces at "a" in FIGS. 13, 14, and 15 are those experienced by element 131 at the contact faces in the fully closed position; the forces at "e" in the same FIGS. correspond to the position of element 132 shown in FIG. 12*e*. The forces $F_p$, $F_n$, and $F_r$ in FIGS. 13, 14, and 15 are all forces exerted on the contact faces and exclude the same type of minor forces referred to above as being omitted in connection with FIGS. 5–10 inclusive. FIG. 12*b* illustrates the initial contact make-break position for contact elements 131, 141 while a similar but spaced apart position for elements 132, 142 is revealed in FIG. 12*d* to produce a contact gap b–d about $\frac{1}{3}$ the total distance of travel for the contact elements. The contacts of the elements are formed entirely of silver. In FIG. 12*c* the switches are in the midpoint "c" of travel and at this location are both in nonengaging positions where no forces are acting on either pair of elements.

In the PRIOR ART device the discontinuities are appreciable and the maximum positive spring gradient force $F_1$ (FIG. 13) is not substantially different from a similar force $F_2$ at positions "a" and "e". By way of illustration one typical PRIOR ART 3 ART 24 cold control had an $F_1$ of 18 grams and an $F_2$ of 26 grams. Thus $(F_1-F_1)/F_2$ is 0.31 and of course is substantially less than unity. In addition force curve $F_p$ produced by spring 144 is not in effect a single linear curve (compare $F_{pc}$ in FIG. 8). Moreover, the net work evidenced by FIG. 15 is slightly more than that shown by FIG. 10 even though the force characteristics in the PRIOR ART device are not nearly as desirable as those in FIG. 8. Thus, a PRIOR ART device having these characteristics, even with contacts formed entirely of silver and having the same overall sizes as the laminated ones in the illustrated embodiment, in actual tests generally produce forces $F_2$ at the engaging contact faces in the range from 24 to about 44 grams. By contrast one constructed in accordance with FIGS. 1, 2, and 8–10 inclusive generated forces $F_2$ of 50 to 70 grams for contact operation, yet also had a load life increase of about six times over that of the PRIOR ART device even with a 69% reduction in silver utilization for the same size contacts.

Figure 16:
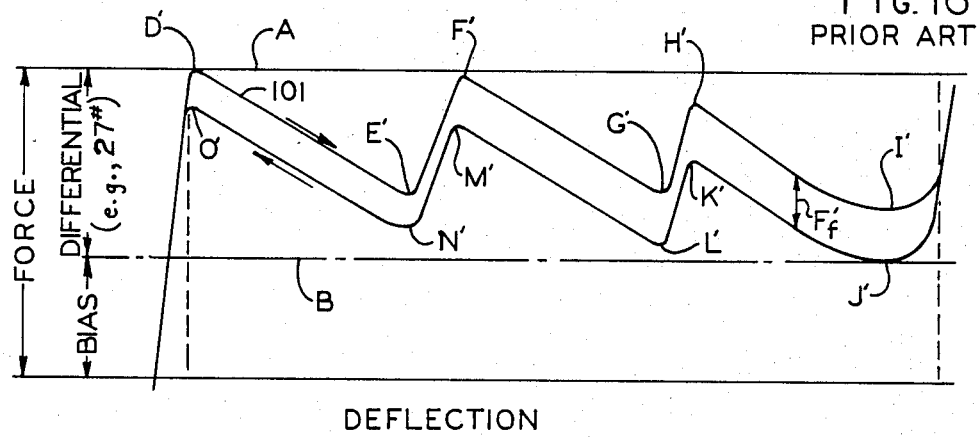
FIG. 16 PRIOR ART
FIG. 16 is an X-Y diagram similar to that of FIG. 11 except that it is typical of switching forces for condition responsive electric switch systems of PRIOR ART devices which do not incorporate the present invention.

Other benefits of the present invention may be better appreciated when comparing the force-deflection characteristics of the embodiment illustrated by FIG. 11 with a similar X-Y diagram curve 101 in FIG. 16 which is typical of similar sized PRIOR ART electrical switching devices having two sets of switch elements not employing the present invention. Curve 101 is representative of the same kind of PRIOR ART General Electric cold control Model 3 ART 24 referred to above. In FIG. 16 the same letters are employed to denote the same things, except that a prime number is also used. It will be observed that unlike curve 96, the forces at E′, F′ are in the vicinity of force level A and similarly forces at L′, and K′ are near force level B. Force $F'_f$ denotes two times the friction force. The potential for a stalled condition as evidenced by curve 101; thus shorter contact life for the PRIOR ART switch mechanism of FIG. 16, is greater than that for the one illustrated by curve 96 in FIG. 11 and requires a more difficult and costly adjustment to maintain quality characteristics in the PRIOR ART device.

FIGS. 17*a, c,* and *e,* 18, 19, and 20 pertain to another embodiment of the present invention in which the switch mechanism includes a single set of switch elements 31', 41', and terminals 27', 28' similar in construction to elements 31, 41 and terminals 27, 28 already described in connection with the first embodiment of FIGS. 1–7. Actuator member is identified at 54', positive gradient spring 44', and a stop for element 32' is denoted by 49' which may be defined by a shoulder of housing 21. As in the first embodiment, position "a" shows the positive, negative, and net resultant forces $F_{p\text{-}c}$, $F_{nc}$, and $F_{rc}$ respectively in FIGS. 18, 19, and 20 with the elements in fully open position. Similarly position "c" is the initial contact make-break position and "e" is the fully closed position. $F_{rc}$ of FIG. 20 approximates that in FIG. 7 and the value of the expression $(F_2-F_1)/F_2$ is unity for this embodiment. It will be obvious to those skilled in the art that the second embodiment has the same advantageous operating attributes in regard to the single set of elements that the switch mechanism had for the two sets in the first embodiment. As a practical matter to insure satisfactory operation under even adverse conditions in the switch mechanism of the second embodiment, the negative gradient spring means, such as one similar to spring 64, could be adjusted to furnish a generally linear force line $F_{ncl}$ in FIG. 19 for the entire operation between positions "a" and "e". As seen in FIG. 20 there is a slight differential between the negative and positive net linear forces $F_{rcl}$ for open and closed positions, at "a" and "e" respectively, but the amount of net work being represented between the linear broken line curves $F_{rcl}$ and line 0—0 is very small. This type of adjustment could, of course, also be accomplished for the device having two sets of contact elements if desired for the same reasons.

It will be appreciated from the foregoing that the present invention provides improved condition responsive electric switch systems, electrical switching devices and methods of operation in which the units may be easily and compactly constructed, are low in cost, yet are capable of operating properly over long periods of time. In addition the invention is versatile in nature and may furnish amplification of contact forces in a simple manner to provide a net force gain without contact bounce being experienced in the switching modes even when a substantial is not redesign required for existing devices. For example, one form of the invention was incorporated in a 3ARR4 General Electric Company relay of a type disclosed in U.S. Pat. No. 2,866,025 except that it was of a single pole, normally open version and contact element spacings and spring gradients were changed. Its resultant net contact element force vs. deflection curve was basically similar to that of FIG. 20 while the magnetic pull was actually reduced to half of that for the original relay. Contact force $F_2$ of the relay was increased from 30 grams (the original relay) to 100 grams. The value of the expression $(F_2-F_1)/F_2$ for the relay which included a form of our invention was essentially unity and $F_2$ was of substantially greater magnitude than that of $F_1$ which approximated zero. Also, the life of trouble free operation, as indicated from the tests, seemed to increase from 70,000 operations for the original relay to about 420,000 operations for the one of the same size modified to incorporate the present invention. Thus certain presently existing electrical switching devices may, by simple yet critical adjustments of component spacings and certain spring gradients, be conveniently modified to incorporate a form of the present invention with associated benefits without incurring much expense in total redesign. Moreover, these devices of a certain size may be utilized for applications requiring a large number of trouble free cycles of operations where heretofore it was not possible to do so. We therefore aim in the following claims to cover all such equivalent variations as fall within the true spirit and scope of the invention.

What we claim as new and desire to secure by Letters Patent of the United States is:

1. A condition responsive electric switch system comprising switch means including at least one set of contact elements defining a preselected open position, a preselected closed position, and a preselected initial contact make-break position, disposed between said open and closed positions; switch actuating means movable in actuating relation with said switch means for operating said contact elements selectively into and out of said preselected open, closed, and initial make-break positions; spring means and temperature responsive means connected to switch actuating means for imparting motion to said switch actuating means, with said spring means and temperature responsive means creating opposing forces on said switch actuating means; and the condition responsive electric switch system having both major positive and negative spring gradients including a force producing means having maximum absolute positive gradient forces $F_1$ and $F_2$ in which $F_1$ = maximum absolute positive gradient pre-load force on said contact elements at said preselected initial make-break position; $F_2$ = maximum absolute positive gradient force on said contact elements at said preselected closed position wherein the value of the expression $(F_2-F_1)/F_2$ approaches unity and a net contact element force $F_{rc}$ is produced generally in the vicinity of zero as the contact elements travel at least through said preselected initial contact make-break position.

2. The condition responsive electric switch system of claim 1 having means for adjusting at least the larger absolute negative spring gradients in the system.

3. The condition responsive electric switch system of claim 1 in which the preselected initial contact make-break position of the at least one set of contact elements is located approximately midway of the total distance between said preselected open and closed positions of that set of contact elements.

4. The condition responsive electric switch system of claim 1 in which the major positive and negative spring gradients are of generally similar but opposed magnitudes as the at least one set of contact elements operate between the preselected open and closed positions.

5. The condition responsive electric switch system of claim 1 in which the positive and negative gradients together produce essentially $F_{rc}$ in the vicinity of zero as the at least one set of contact elements operate between said preselected open and closed positions through said preselected initial make-break position.

6. The condition responsive electric switch system of claim 1 in which said switch means comprises first and second movable contact elements respectively and selectively operable with first and second fixed contact elements to define two sets of switch elements, with each set of switch elements having preselected open, closed, and make-break positions; said force producing means having an absolute positive gradient connected in said switch means between said first and second movable contact elements to produce an absolute positive force $F_p$ on said contact elements; the major positive and negative spring gradients of the condition responsive electric switch system together producing essentially similar net forces for both sets of switch elements as each set operates between their respective preselected open and closed positions and $F_p$ is in effect a generally single linear line of force between said preselected open and closed positions.

7. The condition responsive electric switch system of claim 6 in which said preselected make-break positions of the respective two sets of switch elements are located relative to one another to define a contact gap therebetween no greater than about ¼ of the total distance of operation of said movable contact elements.

8. The condition responsive electric switch system of claim 1 in which the major positive and negative spring gradients are each generally linear during the greater portion of the selective operation of the at least one set of contact elements between said preselected positions.

9. The condition responsive electric switch system of claim 1 in which the forces $F_1$ and $F_2$ of the force producing means are in effect in a single linear directed force.

10. An electrical switch device comprising switch means including at least one set of contact elements operable generally between a preselected open position and a preselected closed position through a preselected initial contact make-break position disposed between said open and closed positions; switch actuating means movable in actuating relation with said switch means for operating said contact elements selectively into and out of said preselected open, closed, an initial make-break positions; means for imparting motion to said switch actuating means and having predetermined positive and negative spring gradients respectively producing individual absolute forces $F_{pc}$ and $F_{nc}$ on said at least one set of contact elements in which $F_{pc}$ includes a force $F_1$, where $F_1$=a maximum absolute positive gradient pre-load force on said contact elements at said preselected initial make-break position; and in which $F_{pc}$ includes force $F_2$where $F_2$=a maximum absolute positive gradient force on said contact elements at said preselected closed position, with the value of the expression $(F_2-F_1)/F_2$ being not substantially less than unity, and further with forces $F_{pc}$ and $F_{nc}$ together producing a net contact element force generally in the vicinity of zero as the contact elements operate at least through said preselected initial contact make-break position.

11. The electrical switch device as set forth in claim 10 further comprising means associated with said acutating means for adjusting at least the value of $F_{nc}$.

12. The electrical switch device as set forth in claim 11 in which the preselected initial contact make-break position of the at least one set of contact elements is located approximately one-half of the total distance between said preselected open and closed positions of that set of contact elements.

13. The electrical switch device as set forth in claim 10 wherein the predetermined negative and positive spring gradients are of generally similar but opposed magnitudes as the at least one set of contact elements operate between the preselected open and closed positions.

14. The electrical switch device of claim 10 in which the forces $F_1$ and $F_2$ of the force producing means are in effect in a single linear line of force.

15. An electrical switching device comprising switching means selectively operable generally between a pair of switching modes; resilient means having a positive spring gradient of predetermined value associated with said switching means for exerting a force on said switching means at a first predetermined force level as said switching means enters and leaves the pair of switching modes, and at a second predetermined force level substantially higher than the first predetermined force level when said switching means is in at least one of said switching modes; actuator means associated with said resilient means and said switching means for effecting the operation of said switching means between its switching modes and for introducing at least a negative spring gradient of predetermined value on said switching means at least generally as said switching means enters and leaves the switching modes thereof of sufficient magnitude so as to generally approximate and off-set the force of said resilient means as said switching means enters and leaves one of its one switching modes.

16. The electrical switching spring device of claim 15 including means for adjusting at least one of the spring gradients with a net force acting on said switching means essentially approaching zero in at least one of its switching modes.

17. The electrical switching device of claim 15 in which said switching means includes a pair of movable contact elements with said resilient means mounted therebetween to produce a positive spring gradient on both movable contact elements and a wiping action as the switching means enters one of the switching modes.

18. The electrical switching device of claim 15 in which the positive spring gradient of the resilient means defines in effect a single linear line of force throughout the pair of switching modes.

19. A method of operating an electrical switching device through switching modes, the switching device having at least one set of contact elements defining open, closed and initial make-break positions, with the initial make-break position disposed between the other two positions; the method comprising the steps of:

transferring the contact element into and out of the open and closed positions by means including both positive and negative spring gradients; and passing the contact elements through the initial make-break position by the means while producing a force on the contact elements resulting from the positive spring gradient substantially greater in magnitude as the contact elements are in the closed position than the magnitude of a force resulting from the same positive spring gradient when the contact elements are entering and leaving the switching modes while concurrently producing a net force essentially approaching zero on the contact elements as the contact elements enter and leave the initial make-break position.

20. The method of claim 19 in which the transferring of the contact elements into and out of the open and closed positions is achieved by producing a net force essentially in the vicinity of zero on the contact elements.

21. The method of claim 19 in which the passing of the contact elements through the initial make-break position occurs at a location approximately half way between the open and closed positions.

22. A method of operating an electrical switching system including switching means operable generally between a pair of switching modes, and resilient means for exerting a force having both positive and negative gradients, the method comprising the steps of:

effecting the operation of the switching means between its switching modes and applying the positive and negative gradients of the force of the resilient means so as to produce a force on the switching means by the positive gradients substantially greater in the switching modes than the forces on the switching means as the switching means enter and leave the switching mode, with the net effect of the positive and negative spring gradients applying a net force on the switching means generally near zero as the switching means at least both enter and leave the switching modes thereof.

23. The method of operating an electrical switching system of claim 22 wherein the switching means includes a pair of switching devices each being operable between a pair of switching modes, the method further comprising the steps of effecting selective operation of each switching device between its respective pair of switching modes and applying a net force that generally is in the vicinity of zero as each device enters and leaves its respective switching mode thereof.

24. The method of operating an electrical switching system of claim 22 including the additional step of increasing one of the positive and negative spring gradients at least generally as the switching means both enter and leave the switching modes thereof.

* * * * *